US009199302B2

(12) United States Patent
Fusayasu et al.

(10) Patent No.: US 9,199,302 B2
(45) Date of Patent: Dec. 1, 2015

(54) ASSEMBLY JIG FOR PINS FOR POWER TRANSMISSION CHAIN

(75) Inventors: Kouji Fusayasu, Kashiwara (JP); Akihito Kanemoto, Kashiba (JP)

(73) Assignee: JTEKT CORPORATION, Osaka (JP)

( * ) Notice: Subject to any disclaimer, the term of this patent is extended or adjusted under 35 U.S.C. 154(b) by 1006 days.

(21) Appl. No.: 13/313,280

(22) Filed: Dec. 7, 2011

(65) Prior Publication Data

US 2012/0146278 A1 Jun. 14, 2012

(30) Foreign Application Priority Data

Dec. 10, 2010 (JP) ..... 2010-275226

(51) Int. Cl.
*B23Q 3/18* (2006.01)
*B21L 9/06* (2006.01)
*B21L 19/00* (2006.01)

(52) U.S. Cl.
CPC *B21L 9/065* (2013.01); *B21L 19/00* (2013.01)

(58) Field of Classification Search
CPC ..... B23Q 3/104; B25B 5/14; B25B 5/163
USPC ..... 269/287, 289 R, 302.1, 900, 903; 29/281.1
See application file for complete search history.

(56) References Cited

U.S. PATENT DOCUMENTS 4,794,687 A * 1/1989 Peters et al. ..... 29/559
5,941,700 A * 8/1999 Fuchs ..... 432/258
7,140,173 B2 11/2006 Van Rooij
8,006,966 B2 * 8/2011 Kwon ..... 269/48.1
2006/0267262 A1 * 11/2006 Schiavi et al. ..... 269/21
2007/0289284 A1 12/2007 Fuse
2008/0137261 A1 * 6/2008 Naito et al. ..... 361/301.1
2008/0184692 A1 8/2008 Miura
2012/0146278 A1 * 6/2012 Fusayasu et al. ..... 269/287

FOREIGN PATENT DOCUMENTS

EP 1 952 907 A1 8/2008
GB 1 261 282 1/1972
JP A-2006-95531 4/2006
JP A-2006-095583 4/2006
JP A-2009-119507 6/2009

OTHER PUBLICATIONS

Mar. 13, 2012 Search Report issued in European Patent Application No. 11192515.2.

* cited by examiner

*Primary Examiner* — Lee D Wilson
(74) *Attorney, Agent, or Firm* — Oliff PLC

(57) ABSTRACT

An assembly jig for pins includes a jig body in which pin insertion recesses, into which respective pairs of pins and interpieces are inserted, are aligned at predetermined intervals, and urging devices that urge lower end portions of both the pins and the interpieces, which are fitted in the pin insertion recesses, in the direction perpendicular to the axial direction of the pins and the interpieces. In the jig body, urging device installation recesses are formed so as to be contiguous with the consecutive pin insertion recesses. Each urging device is arranged in the corresponding urging device installation recess, and includes a helical compression spring of which the urging direction is the radially outward direction, and a pressing member urged by the helical compression spring. The pressing member has a first pressing face that contacts the pin, and a second pressing face that contacts the interpiece.

3 Claims, 8 Drawing Sheets

ASSEMBLY JIG FOR PINS FOR POWER TRANSMISSION CHAIN

INCORPORATION BY REFERENCE

The disclosure of Japanese Patent Application No. 2010-275226 filed on Dec. 10, 2010 including the specification, drawings and abstract, is incorporated herein by reference in its entirety.

BACKGROUND OF THE INVENTION

1. Field of the Invention

The invention relates generally to an assembly jig for pins for a power transmission chain, and more specifically to an assembly jig for pins for a power transmission chain suitable for a continuously variable transmission (CVT) of a vehicle such as an automobile.

2. Description of the Related Art

A power transmission chain suitable for a continuously variable transmission for an automobile includes a plurality of links, a plurality of first pins, and a plurality of second pins. Each link has front and rear insertion portions through which the pins are passed. Each first pin and a corresponding one of the second pins are aligned next to each other in the longitudinal direction of the links, and connect the links, aligned in the chain width direction, to each other such that the front insertion portion of one link corresponds to the rear insertion portion of another link. The first pins and the second pins move while being in rolling contact with respect to each other, so that the links are flexural with respect to each other in the chain length direction. Thus, the chain is able to shift from the straight state to the curved state. In a known power transmission chain, one of a first pin and a second pin is fixed to a front insertion portion of one link through press-fitting and is movably fitted in a rear insertion portion of another link, and the other of the first pin and the second pin is movably fitted in the front insertion portion of the one link and is fixed to the rear insertion portion of the other link through press-fitting. Japanese Patent Application Publication No. 2006-95583 describes a method of manufacturing such a power transmission chain. According to the method, a required number of pins are arranged with a predetermined pitch (at predetermined intervals) so as to vertically extend, and held in the same arrangement state as that when the pins are assembled into a chain. Then, links are sequentially press-fitted one by one to these pins from the lower ends.

Japanese Patent Application Publication No. 2006-95583 describes the following method of manufacturing a power transmission chain. According to the method, as shown in FIG. 7, while an assembly jig 41 for pins is rotated, each pair of pins 14, 15 is inserted into a corresponding one of pin insertion recesses 42 formed in the assembly jig 41 with a predetermined pitch. In this way, all the pins 14, 15 that are used in a chain 1 are arranged on the assembly jig 41 for pins, and held in the same arrangement state as that when the pins 14, 15 are assembled into the chain 1. Then, as shown in FIG. 8, links 11 used in the chain 1 are sequentially press-fitted to these pins 14, 15 by pressing jigs 45 such that the links 11 are laminated on top of each other in the chain width direction.

Further, a similar assembly jig for pins is described in, for example, U.S. Pat. No. 7,140,173.

The aforementioned conventional method of manufacturing a power transmission chain and the aforementioned conventional assembly jig for pins for a power transmission chain may cause the following inconvenience. That is, some pins that are loosely fitted in the assembly jig due to dimensional variations in manufacturing may topple down while the assembly jig for pins rotates. Accordingly, it is preferable to provide a device used to retain the pins. However, it is difficult to provide a retention device in such a manner that the retention device does not hinder press-fitting of the links by the pressing jigs. Therefore, retaining the pins with a compact and simple mechanism is a task that should be accomplished.

SUMMARY OF THE INVENTION

It is an object of the invention to provide an assembly jig for pins for a power transmission chain, which makes it possible to retain pins with a compact and simple mechanism.

An aspect of the invention relates to an assembly jig for pins, which is used to manufacture a power transmission chain that includes a plurality of links each having front and rear insertion portions through which pins are passed, and a plurality of first pins and a plurality of second pins. Each first pin and a corresponding one of the second pins are aligned next to each other in the longitudinal direction of the links, and the first pins and the second pins connect the links, aligned in the chain width direction, to each other such that the front insertion portion of one link corresponds to the rear insertion portion of another link. The first pins and the second pins move while being in rolling contact with respect to each other, so that the links are flexural with respect to each other in the chain length direction. Thus, the chain is able to shift from the straight state to the curved state. One of the first pin and the second pin is fixed to the front insertion portion of the one link through press-fitting and is movably fitted in the rear insertion portion of the other link, and the other of the first pin and the second pin is movably fitted in the front insertion portion of the one link and is fixed to the rear insertion portion of the other link through press-fitting. The assembly jig includes a jig body in which pin insertion recesses, into which respective pairs of pins are inserted, are aligned at predetermined intervals. The jig body has urging device installation recesses formed so as to be contiguous with the respective pin insertion recesses. In each urging device installation recess, there is arranged an urging device that urges a lower end portion of the pin fitted in the pin insertion recess in the direction perpendicular to the axial direction of the pins.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Hereafter, embodiments of the invention will be described with reference to the accompanying drawings. In the following description, the up-and-down direction in a power transmission chain signifies the up-and-down direction in FIG. 2, and the up-and-down direction in an assembly jig for pins signifies the up-and-down direction in FIG. 5.

Figure 1:
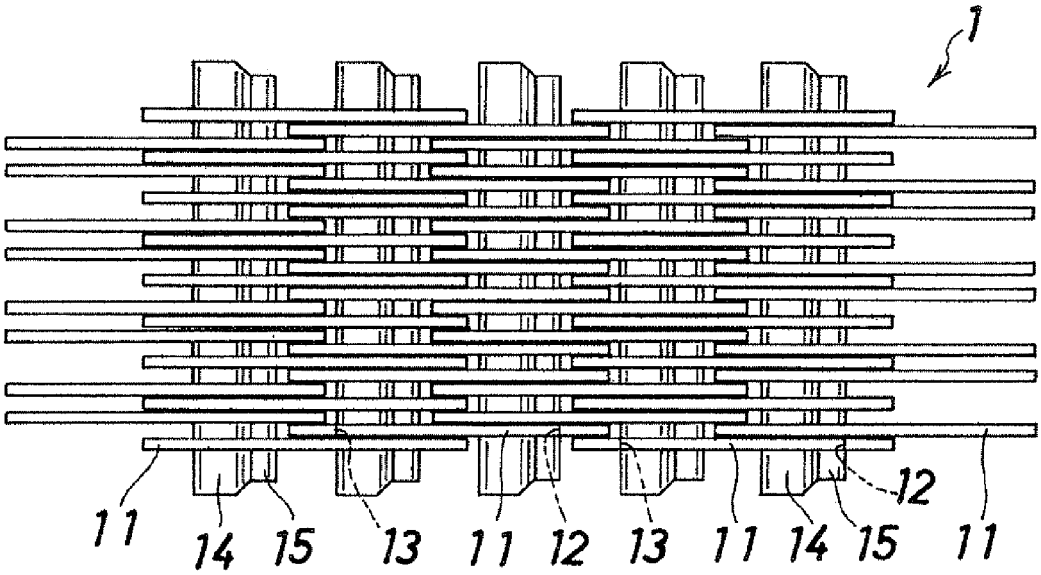
FIG. 1 is a plain view showing part of a power transmission chain that is manufactured with the use of an assembly jig for pins for a power transmission chain according to an embodiment of the invention.

FIG. 1 shows part of a power transmission chain that is manufactured with the use of an assembly jig for pins for a power transmission chain according to the invention. A power transmission chain 1 includes a plurality of links 11, a plurality of pins (first pins) 14, and a plurality of interpieces (second pins) 15. Each link 11 has a front insertion portion 12 and a rear insertion portion 13 that are formed at a predetermined interval in the chain length direction.

The pins (first pins) 14 and the interpieces (second pins) 15 connect the links 11, aligned in the chain width direction, to each other such that the links 11 are flexural with respect to each other in the chain length direction. Thus, the chain 1 is able to shift from the straight state to the curved state. The interpiece 15 is shorter than the pin 14. The interpiece 15 and the pin 14 face each other such that the interpiece 15 is arranged in front of the pin 14 in the chain traveling direction.

The chain 1 is formed by arranging three link rows, each of which is constituted of a plurality of links having the same phase in the chain width direction, in the chain traveling direction (longitudinal direction) to constitute a single link unit, and connecting a plurality of link units, each of which is constituted of the three link rows, to each other in the chain traveling direction. In the present embodiment, one link row having nine links and two link rows each having eight links constitute a single link unit.

Figure 2:
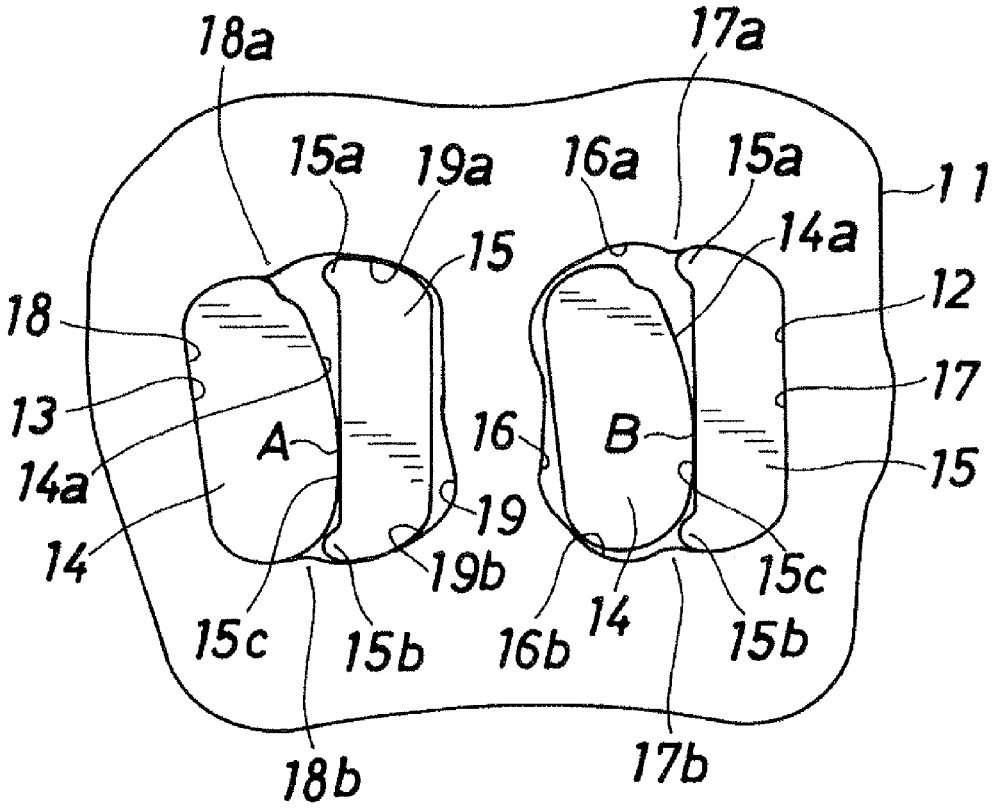
FIG. 2 is an enlarged side view of a link and pins.

As shown in FIG. 2, the front insertion portion 12 of each link 11 is formed of a pin movable portion 16 to which one of the pins 14 is movably fitted, and an interpiece fixation portion 17 to which one of the interpieces 15 is fixed. The rear insertion portion 13 is formed of a pin fixation portion 18 to which another of the pins 14 is fixed, and an interpiece movable portion 19 to which another of the interpieces 15 is movably fitted.

Each pin 14 is wider in the link longitudinal direction than each interpiece 15. Each interpiece 15 has, at its upper and lower edges, protruding edge portions 15*a* and 15*b*, respectively, which extend toward the corresponding pin 14.

In connecting the links 11 aligned in the chain width direction to each other, the links 11 are placed on top of each other such that the front insertion portion 12 of one link 11 corresponds to the rear insertion portion 13 of another link 11. Subsequently, the pin 14 is fixed to the rear insertion portion 13 of the one link 11 and is movably fitted to the front insertion portion 12 of the other link 11. Subsequently, the interpiece 15 is movably fitted to the rear insertion portion 13 of the one link 11 and fixed to the front insertion portion 12 of the other link 11. Then, the pin 14 and the interpiece 15 move while being in rolling contact with respect to each other, so that the links 11 are flexural with respect to each other in the chain length direction (longitudinal direction). Thus, the chain 1 is able to shift from the straight state to the curved state.

At the boundary between the pin fixation portion 18 and the interpiece movable portion 19 of each link 11, there are formed upper and lower arc-shaped convex retention portions 18*a* and 18*b* which are contiguous with upper and lower arc-shaped concave guide portions 19*a* and 19*b* of the interpiece movable portion 19, respectively, and which retain the pin 14 fixed to the pin fixation portion 18. Similarly, at the boundary between the interpiece fixation portion 17 and the pin movable portion 16, there are formed upper and lower arc-shaped convex retention portions 17*a* and 17*b* which are contiguous with upper and lower arc-shaped concave guide portions 16*a* and 16*b* of the pin movable portion 16, respectively, and which retain the interpiece 15 fixed to the interpiece fixation portion 17.

The locus of a contact position, at which the pin 14 and the interpiece 15 contact each other, with respect to the pin 14 is the involute of a circle. In the present embodiment, a rolling contact surface 14*a* of the pin 14 is an involute curve having a base circle with a center M and a radius Rb in cross-section, and a rolling contact surface 15*c* of the interpiece 15 is a flat surface (of which the cross-sectional shape is rectilinear). Thus, when each link 11 shifts from a rectilinear region of the chain 1 to a curve region thereof or from the curve region to the rectilinear region, in the front insertion portion 12, the pin 14 moves within the pin movable portion 16 with respect to the fixed interpiece 15 while the rolling contact surface 14*a* of the pin 14 is in rolling contact (including slight sliding contact) with the rolling contact surface 15*c* of the interpiece 15. At this time, in the rear insertion portion 13, the interpiece 15 moves within the interpiece movable portion 19 with respect to the fixed pin 14 while the rolling contact surface 15*c* of the interpiece 15 is in rolling contact (including slight sliding contact) with the rolling contact surface 14*a* of the pin 14.

Figure 3:
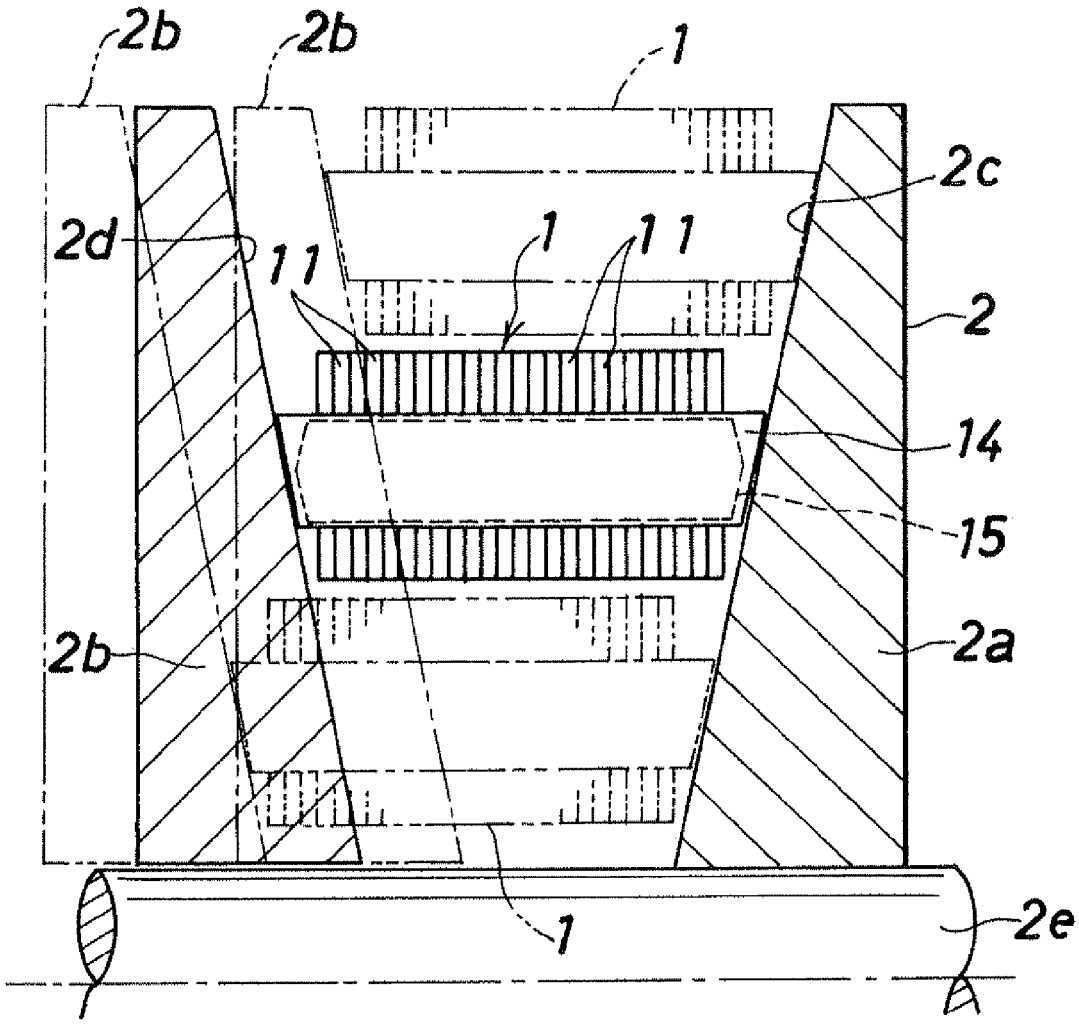
FIG. 3 is a front view showing the state where the power transmission chain is attached to a pulley.

The power transmission chain 1 is used in a continuously variable transmission (CVT). In this case, as shown in FIG. 3, end faces of each pin 14 are in contact with a conical sheave face 2*c* of a fixed sheave 2*a* of a drive pulley 2 having a pulley shaft 2*e* and a conical sheave face 2*d* of a movable sheave 2*b* of the drive pulley 2, with end faces of each interpiece 15 out of contact with the conical sheave faces 2*c* and 2*d* of the drive pulley 2. Power is transmitted under frictional force resulting from the contact between the end faces of each pin 14 and the conical sheave faces 2*c*, 2*d*.

As shown in FIG. 3, if the movable sheave 2*b* of the drive pulley 2, which is located at a position indicated by solid lines, is moved toward/away from the fixed sheave 2*a*, the running diameter of the circle of rotation of the drive pulley 2 increases as the movable sheave 2*b* moves toward the fixed sheave 2*a*, and decreases as the movable sheave 2*b* moves away from the fixed sheave 2*a*, as indicated by chain lines. Although not shown in the drawings, a movable sheave of a driven pulley moves toward a fixed sheave as the movable sheave 2*b* of the drive pulley 2 moves away from the fixed sheave 2*a*, and moves away from the fixed shave as the movable sheave 2*b* moves toward the fixed sheave 2*a*. As the running diameter of the circle of rotation of the drive pulley 2 increases, the running diameter of the circle of rotation of the driven pulley decreases. As the running diameter of the circle of rotation of the drive pulley 2 decreases, the running diameter of the circle of rotation of the driven pulley increases. As a result, the underdrive (U/D) state where the running diameter of the circle of rotation of the drive pulley 2 is minimized and the running diameter of the circle of rotation of the driven pulley is maximized is obtained, or the overdrive (O/D) state where the running diameter of the circle of rotation of the drive pulley 2 is maximized and the running diameter of the circle of rotation of the driven pulley is minimized is obtained, using the state where the speed change ratio is 1:1 (initial value) as a reference state.

The power transmission chain 1 is manufactured by retaining a required number of pins 14 and a required number of interpieces 15, and then sequentially press-fitting a required number of links 11 to the pins 14 and the interpieces 15. The links 11 are press-fitted to the pins 14 and the interpieces 15 such that the upper and lower edges of the pin 14 are fixed to the upper and lower edges of the pin fixation portion 18, respectively, and the upper and lower edges of the interpiece 15 are fixed to the upper and lower edges of the interpiece fixation portion 17, respectively, as shown in FIG. 2. The press-fitting interference is set to 0.005 mm to 0.1 mm.

A method of manufacturing the power transmission chain is similar to a conventional method, and includes a pin retaining step and a link press-fitting step. In the pin retaining step, all the pins 14 and interpieces 15 used in the chain 1 are grouped into multiple pairs each including one pin 14 and one interpiece 15, and the multiple pairs of pin 14 and interpiece 15 are arranged on an assembly jig 20 (30) for pins with a predetermined pitch (at predetermined intervals) and retained in the same arrangement state as that when the pins 14 and the interpieces 15 are assembled into the chain 1. In the link press-fitting step, the links 11 used in the chain 1 are sequentially press-fitted to the pins 14 and the interpieces 15 so as to be laminated on top of each other in the chain width direction.

Figure 7:
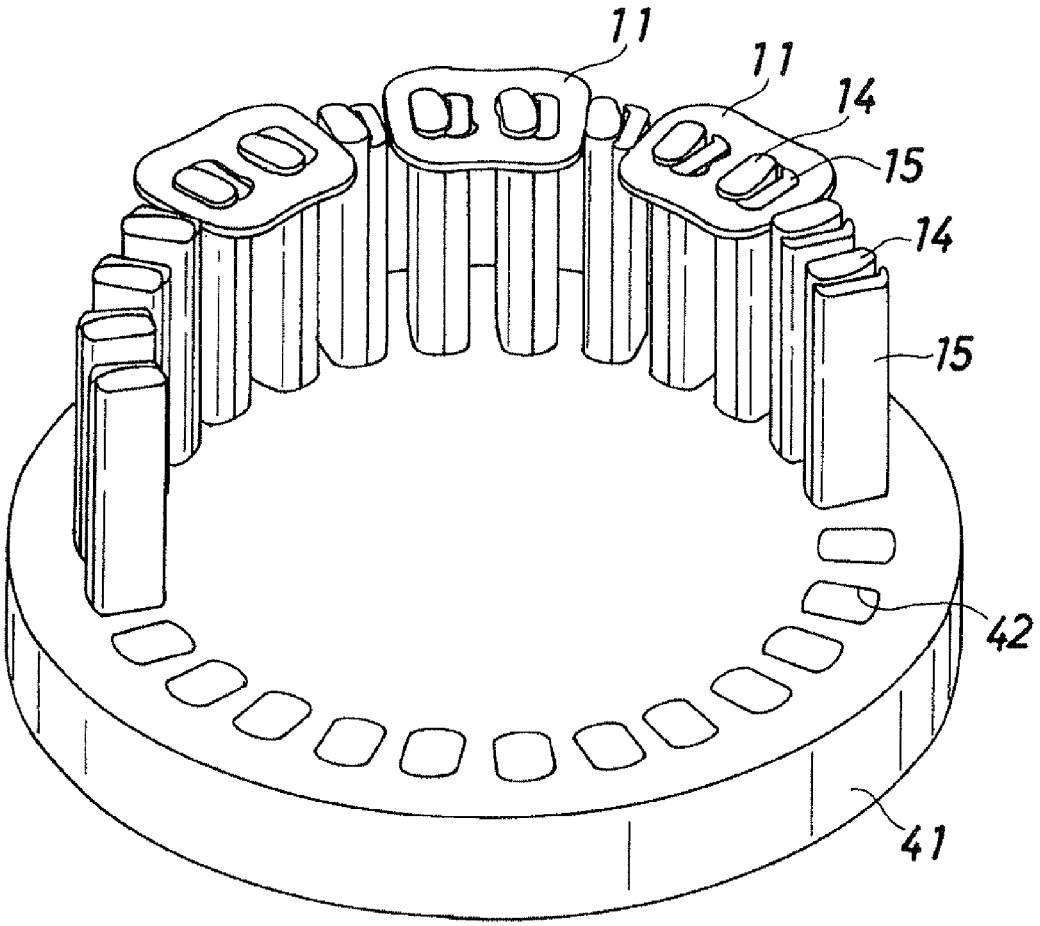
FIG. 7 is a perspective view showing a conventional assembly jig for pins.
Figure 8:
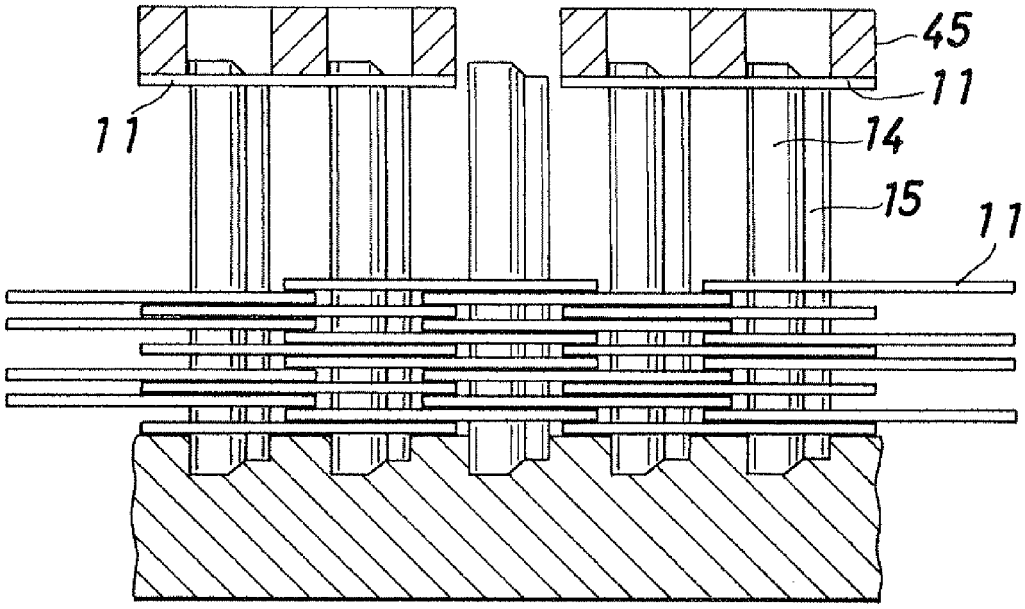
FIG. 8 is a vertical sectional view showing the conventional assembly jig for pins.

As shown in FIGS. 7 and 8, a conventional assembly jig 41 for pins is designed to retain the pins 14 and the interpieces 15 using only frictional forces generated by fitting the lower ends thereof into pin insertion recesses 42. In contrast, urging devices 24 (34) that generate elastic forces are provided in the assembly jig 20 (30) for pins according to the invention, as will be described below.

Figure 4:
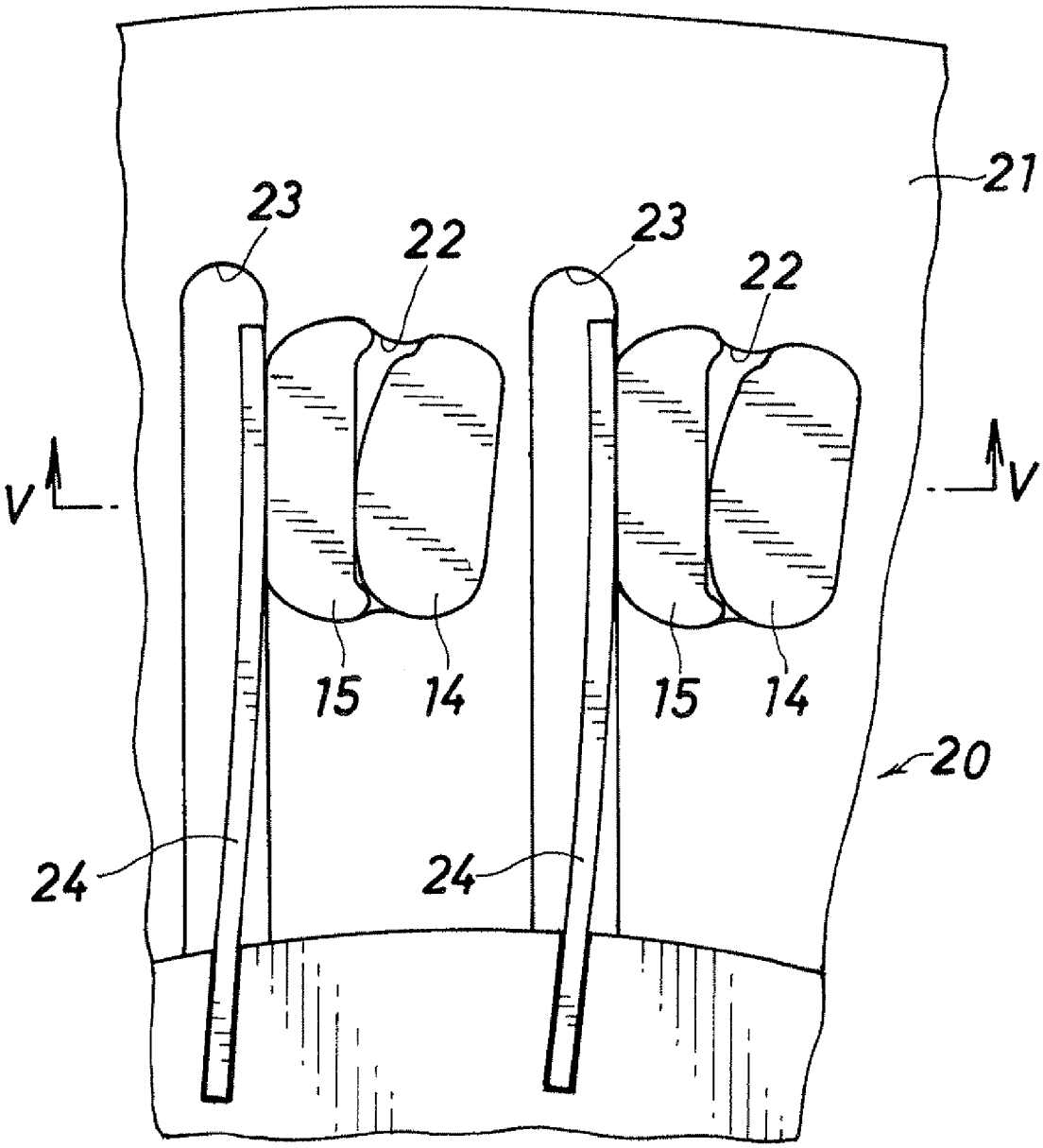
FIG. 4 is a plain view showing an assembly jig for pins for a power transmission chain according to a first embodiment of the invention.
Figure 5:
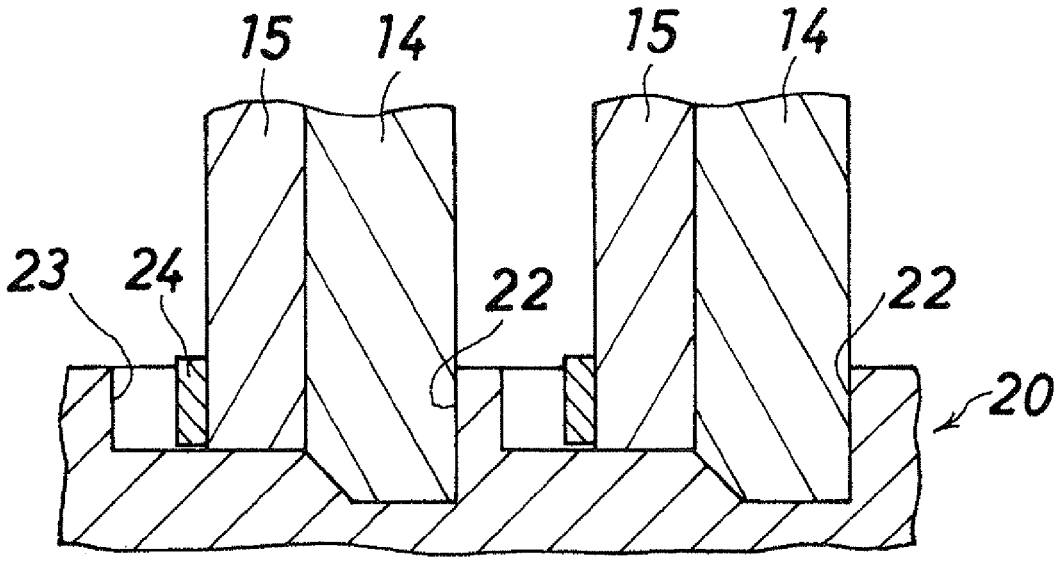
FIG. 5 is a vertical sectional view of the assembly jig.

FIGS. 4 and 5 show the assembly jig 20 for pins for a power transmission chain according to a first embodiment of the invention. As shown in FIGS. 4 and 5, the assembly jig 20 for pins includes a jig body 21 and the urging devices 24. In the jig body 21, pin insertion recesses 22, into which the respective pairs each including one pin 14 and one interpiece 15 are inserted, are formed at predetermined intervals. The urging device 24 urges the lower end portion of the interpiece 15 fitted in the pin insertion recess 22 in the direction perpendicular to the axial direction of the interpiece 15 (in the direction parallel to the upper face of the assembly jig 20 for pins).

The jig body 21 has a circular shape (circular disc-shape). In the jig body 21, urging device installation recesses 23 are formed so as to be contiguous with the respective pin insertion recesses 22 in the direction in which the pin insertions recesses are aligned (in the circumferential direction of the jig body 21). The urging device installation recess 23 is formed next to a portion of the pin insertion recess 22, into which the interpiece 15 is inserted. The urging device installation recess 23 has an elongated shape with a narrow width, and extends inward in the radial direction of the jig body 21.

Each urging device 24 may be a leaf spring, and is provided in the urging device installation recess 23 so as to be able to urge the interpiece 15 in the circumferential direction (the direction in which the pin insertion recesses 22 are aligned) and so as to be deformable in the direction away from the interpiece 15.

Each pin insertion recess 22 has a bottom, and the depth thereof coincides with the amount (stick-out amount) by which the pin 14 and the interpiece 15 each stick out of the outermost one of the links 11 aligned in the chain width direction. The bottom face of each pin insertion recess 22 is stepped such that the pin 14 and the interpiece 15 stick out of the outermost link 11 by predetermined amounts. The transverse sectional shape of the pin insertion recess 22 is substantially the same as the shape of each of the front and rear insertion portions 12 and 13 of the link 11. The pin insertion recess 2 is formed such that the pin 14 and the interpiece 15 are able to be inserted into and removed from the pin insertion recess 22 and the inserted pin 14 and inter-pin 15 are immovable.

The assembly jig 20 for pins is rotatable about its vertical axis. When the power transmission chain 1 is manufactured, first of all, the pins 14 and the interpieces 15 are inserted into the respective pin insertion recesses 22 while the assembly jig 20 for pins is rotated. Subsequently, the links 11 are arranged at upper ends of the pins 14 and the interpieces 15 by a link supply device (not shown). Subsequently, link pressing jigs (see FIG. 8) are lowered to move the links 11 to predetermined positions. After that, rotation of the assembly jig 20 for pins by a predetermined amount, arrangement of the links 11, and lowering of the link pressing jigs are repeated to assemble the power transmission chain 1.

As described above, the transverse sectional shape of the pin insertion recess 22 is designed such that the inserted pin 14 and interpiece 15 are immovable. However, some pins 14 and interpieces 15 that are loosely fitted in the assembly jig 20 due to dimensional variations in manufacturing may topple down while the assembly jig 20 for pins rotates.

In the assembly jig 20 for pins according to the first embodiment, the lower end portion of one of the paired pin 14 and interpiece 15 (interpiece 15, in the first embodiment) is pressed by the leaf spring 24 that serves as the urging device in such a direction as to press the other one of the paired pin 14 and the interpiece 15 (pin 14, in the first embodiment). The lower end portion of the pin 14 is pressed to the peripheral face of the pin insertion recess 22, so that the lower end portions of both the pin 14 and the interpiece 15 are retained within the pin insertion recess 22. Thus, the pin 14 and the interpiece 15 no longer topple down. The leaf spring 24 is provided in the urging device installation recess 23, and therefore does not stick out of the upper face of the jig body 21, that is, does not hinder press-fitting of the links 11, which is performed using pressing jigs in a link press-fitting step. The interval between the consecutive pin insertion recesses 22 is determined based on the dimension of the power transmission chain 1. Therefore, it is difficult to ensure a sufficient space for installation of the urging device. However, using the leaf spring as the urging device 24 makes it possible to install the urging device 24 in a small space. In this manner, the pins 14 and the interpieces 15 are retained with a compact and simple mechanism.

Figure 6:
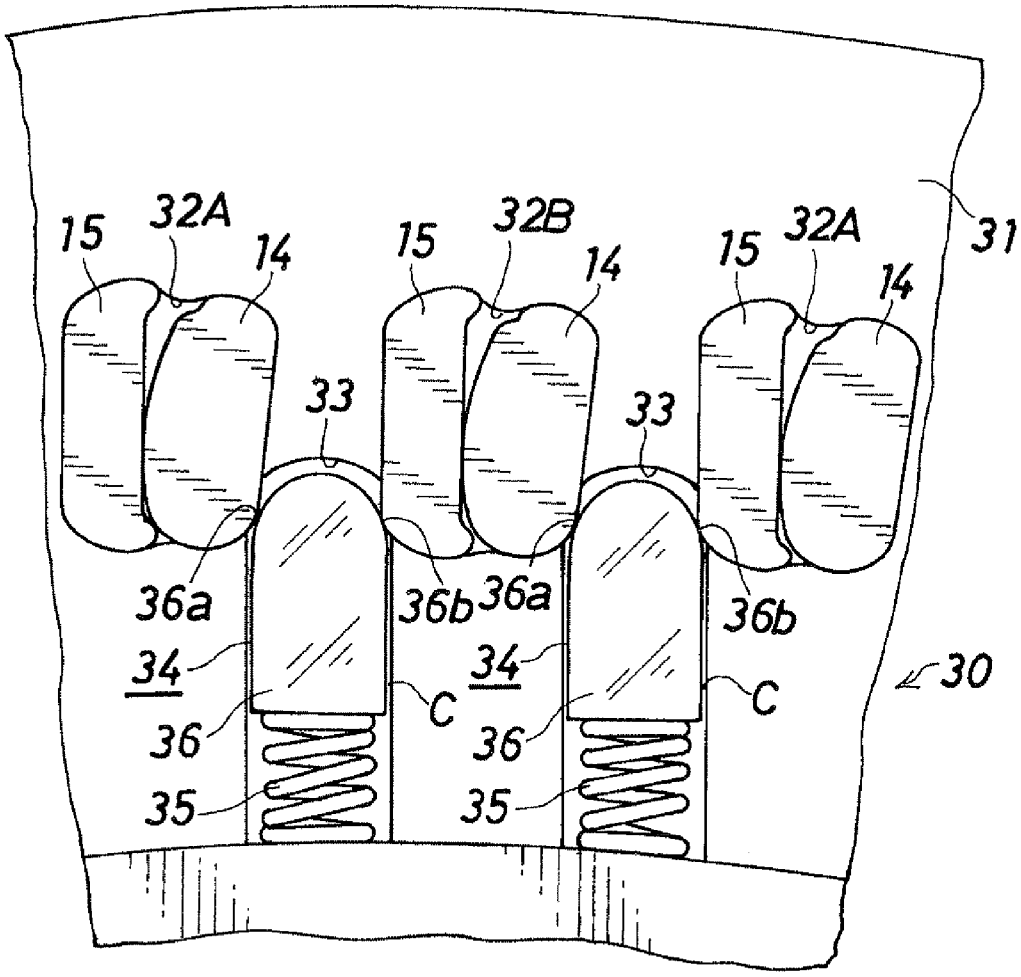
FIG. 6 is a plain view showing an assembly jig for pins for a power transmission chain according to a second embodiment of the invention.

FIG. 6 shows an assembly jig 30 for pins for a power transmission chain according to a second embodiment of the invention. As shown in FIG. 6, the assembly jig 30 for pins according to the second embodiment includes a jig body 31 and urging devices 34. In the jig body 31, pin insertion recesses 32A and 32B, into which the respective pairs each including one pin 14 and one interpiece 15 are inserted, are formed at predetermined intervals. Each urging device 34 urges the lower end portions of both the pin 14 fitted in the pin insertion recess 32B and the interpiece 15 fitted in the pin insertion recess 32A, in the direction perpendicular to the axial direction of the pin 14 and the interpiece 15 (the direction parallel to the upper face of the assembly jig 30 for pins).

The jig body 31 has a circular shape (circular disc-shape). In the jig body 31, urging device installation recesses 33 are formed between the consecutive pin insertion recesses 32A and 32B. Each urging device installation recess 33 is contiguous with radially inward portions of the pin insertion recesses 32A and 32B. The urging device 34 is provided in the urging device installation recess 33, and has a helical compression spring 35 of which the urging direction is the radially outward direction (the direction perpendicular to the direction in which the urging device installation recesses 33 are aligned), and a pressing member 36 urged by the helical compression spring 35.

The pressing member 36 has a first pressing face 36*a* and a second pressing face 36*b*. The first pressing face 36*a* contacts the pin (the pin which is located in the pin insertion recess 32A, at a position close to the pin insertion recess 32B) 14 at a predetermined angle with respect to the direction in which the urging device installation recesses 33 are aligned. The second pressing face 36*b* contacts the interpiece (the pin which is located in the pin insertion recess 32B, at a position close to the pin insertion recess 32A) 15 at a predetermined angle with respect to the direction in which the urging device installation recesses 33 are aligned.

Within the urging device installation recess 33, the pressing member 36 is not only movable in the radial direction (the direction in which the helical compression spring 35 urges pressing member 26), but also movable in the circumferential direction (the direction perpendicular to the direction in which the helical compression spring 35 urges the pressing member 26) due to a clearance C formed between the pressing member 36 and the peripheral face of the urging device installation recess 33 in the circumferential direction.

With this structure, all the pins 14 and interpieces 15 are urged by elastic forces of the helical compression springs 35 via the pressing members 36, respectively. Thus, the pins 14 and the interpieces 15 are reliably prevented from toppling down.

The urging device 34 is provided in the urging device installation recess 33, and therefore does not stick out of the upper face of the jig body 31, that is, does not hinder press-fitting of the links 11 that is performed with the use of the pressing jigs in the link press-fitting step. The interval between the consecutive pin insertion recesses 32A and 32B is determined based on the dimension of the power transmission chain 1. Therefore, it is difficult to ensure a sufficient space for installation of the urging device. However, the urging device 34 is located radially inward of the pin insertion recesses 32A and 32B, and the pin 14 and the interpiece 15 are simultaneously pressed by the single helical compression spring 35 via the pressing member 36. Therefore, the urging device 34 is installed in a small space. In this manner, the pins 14 and the interpieces 15 are retained with a compact and simple mechanism.

The aforementioned assembly jigs 20 and 30 for pins are not limited by the shapes of the links, the pins, or the interpieces, but may be applicable to various power transmission chains.

Each link may be made of, for example, spring steel or carbon tool steel. However, the material of the link is not limited to spring steel or carbon tool steel, but the link may be made of another steel such as bearing steel. The front and rear insertion portions of each link may be through-holes that are separated from each other (each link may have a column portion), or may be a single through-hole (each link may have no column portion). Steel such as bearing steel may be used as the material of the pins. The assembly jig for pins may be made of, for example, carbon tool steel, or alloy tool steel.

In the assembly jig for pins for a power transmission chain according to the invention, the jig body has the urging device installation recesses that are contiguous with the respective pin insertion recesses, and the urging device that urges the lower end portion of the pin fitted in the pin insertion recess, in the direction perpendicular to the axial direction of the pin, is provided in the urging device installation recess. Therefore, the urging device does not hinder press-fitting of the links. As a result, it is possible to retain the pins with a compact and simple mechanism.

What is claimed is:

1. An assembly jig for pins, comprising:

a jig body in which pin insertion recesses, into which respective pairs of pins are inserted, are aligned at predetermined intervals, wherein the jig body has urging device installation recesses formed so as to be contiguous with the respective pin insertion recesses, in each urging device installation recess, there is arranged an urging device that urges a lower end portion of the pin fitted in the pin insertion recess in a direction perpendicular to an axial direction of the pins, each urging device installation recess has an elongated shape and narrower width as compared to the pin insertion recesses, and a base end of the urging device is fixed to the jig body.

2. The assembly jig for pins according to claim 1:

wherein the urging device installation recesses are formed so as to be contiguous with the respective pin insertion recesses in a direction in which the pin insertion recesses are aligned; and wherein each urging device is a leaf spring of which an urging direction coincides with the direction in which the pin insertion recesses are aligned.

3. The assembly jig for pins according to claim 1:

wherein each urging device installation recess is formed between the consecutive pin insertion recesses so as to be contiguous with the consecutive pin insertion recesses;

wherein each urging device includes a coil spring of which an urging direction is perpendicular to the direction in which the pin insertion recesses are aligned, and a pressing member that is urged by the coil spring; and wherein the pressing member has a first pressing face that contacts the pin which is located in one of the consecutive pin insertion recesses, on a side close to the other pin insertion recess, at a predetermined angle with respect to the direction in which the pin insertion recesses are aligned, and a second pressing face that contacts the pin which is located in the other pin insertion recess, on a side close to the one of the consecutive pin insertion recesses, at a predetermined angle with respect to the direction in which the pin insertion recesses are aligned.

* * * * *